US006339649B1

(12) United States Patent
Chen et al.

(10) Patent No.: US 6,339,649 B1
(45) Date of Patent: Jan. 15, 2002

(54) LOUDSPEAKER SYSTEM WITH STACKABLE LOUDSPEAKER UNITS

(76) Inventors: Waterson Chen, 8F, No. 428, Wu-Chuan-Nan Rd., Taichung City; Chin-Lung Lin, No. 12, Cheng-Ping St., San-Min Dist., Kaohsiung City, both of (TW)

( * ) Notice: Subject to any disclaimer, the term of this patent is extended or adjusted under 35 U.S.C. 154(b) by 0 days.

(21) Appl. No.: 09/290,107

(22) Filed: Apr. 12, 1999

(51) Int. Cl.[7] ..... H04R 1/02
(52) U.S. Cl. ..... 381/335; 381/182; 381/332
(58) Field of Search ..... 381/87, 332, 335, 381/336, 345, 186, 182, 386, 150

(56) References Cited

U.S. PATENT DOCUMENTS 5,388,162 A * 2/1995 Sohn ..... 381/182
5,781,645 A * 7/1998 Beale ..... 381/182
6,009,182 A * 12/1999 Gunness ..... 381/182

* cited by examiner

*Primary Examiner*—Minsun Oh Harvey

(74) *Attorney, Agent, or Firm*—Vedder Price Kaufman & Kammholz

(57) ABSTRACT

A loudspeaker system includes at least two loudspeaker units. Each loudspeaker unit includes at least one loudspeaker mechanism mounted on a loudspeaker enclosure. The loudspeaker enclosure includes an outer cabinet body having an open front side, a closed rear side, opposed lateral walls, and opposed top and bottom walls, and an inner baffle frame disposed in the cabinet body. The baffle frame has parallel left and right walls that form a sound space in the baffle frame. The left and right walls further form first clearances with the lateral walls respectively, and have a front portion with the loudspeaker mechanism mounted thereon. The front portion cooperates with the lateral walls to form a pair of acoustic port openings at front ends of the first clearances. The left and right walls further have a rear portion that forms a second clearance with the rear side. The second clearance is communicated with and extends between rear ends of the first clearances. The baffle frame further has a ducting member at the rear portion. The ducting member forms an acoustic path that communicates the sound space and the second clearance such that sound pressure behind the loudspeaker mechanism can be radiated through the acoustic port openings via the sound space, the acoustic path, the second clearance and the first clearances.

12 Claims, 6 Drawing Sheets

LOUDSPEAKER SYSTEM WITH STACKABLE LOUDSPEAKER UNITS

BACKGROUND OF THE INVENTION

1. Field of the Invention

The invention relates to a loudspeaker system, more particularly to a loudspeaker system with stackable loudspeaker units for achieving a surround sound effect.

2. Description of the Related Art

A loudspeaker is used for an audio system and includes a loudspeaker enclosure and a loudspeaker mechanism. When sound is generated by the loudspeaker mechanism, positive and negative sound pressures are produced in front of and behind the loudspeaker mechanism. In the loudspeaker enclosure, the negative sound pressure behind the loudspeaker mechanism creates echo resonance, which can interfere with the sound pressure produced in front of the loudspeaker mechanism so as to affect adversely the quality of sound output.

Referring to FIGS. 1 and 2, a conventional loudspeaker 10 includes a loudspeaker enclosure and tweeter, midrange and woofer loudspeaker mechanisms 141, 142, 143 mounted on the loudspeaker enclosure. The loudspeaker enclosure includes a closed box 15, an inner baffle wall 12 disposed in the box 15, a ducting member 13 disposed in a bottom portion of the box 15, and a plurality of port openings 11 formed in a front side of the box 15. The baffle wall 12 encloses and isolates the tweeter and midrange loudspeaker mechanisms 141, 142 from the woofer loudspeaker mechanism 143. The ducting member 13 includes a horizontal plate 131 and a vertical plate 132 connected to the horizontal plate 131. As such, the sound pressures behind the tweeter and midrange loudspeaker mechanisms 141, 142 can be radiated directly through the upper port opening 11, while the sound pressure behind the woofer loudspeaker mechanism 143 can be radiated through the lower port opening 11 via the ducting member 13 to avoid echo resonance.

The following are some of the drawbacks of the conventional loudspeaker 10:

1. The loudspeaker 10 includes the tweeter, midrange and woofer loudspeaker mechanisms 141, 142, 143, and the sound is radiated in the same direction. Thus, the loudspeaker 10 cannot provide a surround sound effect.

2.The radiating coverage of the port openings 11 is relatively small, and sound is hardly radiated to the whole area of an audiovisual room.

3.Since an inner space of the box 15 is limited, only the sound pressure due to the woofer loudspeaker mechanism 143 is designed to pass through the ducting member 13. As such, the high frequency and midrange frequency response of the loudspeaker 10 is poorer as compared to the lower frequency response of the same.

SUMMARY OF THE INVENTION

Therefore, the main object of the present invention is to provide a loudspeaker system with stackable loudspeaker units that can achieve a surround sound effect.

According to this invention, a loudspeaker system includes at least two loudspeaker units. Each of the loudspeaker units includes a loudspeaker enclosure and at least one loudspeaker mechanism mounted on the loudspeaker enclosure. The loudspeaker enclosure includes an outer cabinet body and an inner baffle frame.

The cabinet body has an open front side, a closed rear side, opposed lateral walls, and opposed top and bottom walls that extend in a first horizontal direction between the front and rear sides.

The baffle frame is disposed in the cabinet body, and has parallel left and right walls that extend in a vertical direction between the top and bottom walls and that form a sound space therebetween. The left and right walls further form first clearances with the lateral walls of the cabinet body respectively, and have a front portion that is proximate to the front side of the cabinet body and that has the loudspeaker mechanism mounted thereon. The front portion of the left and right walls cooperates with the lateral walls to form a pair of acoustic port openings at front ends of the first clearances. The left and right walls further have a rear portion that forms a second clearance with the rear side of the cabinet body. The second clearance is communicated with and extends between rear ends of the first clearances in a second horizontal direction transverse to the first horizontal direction. The baffle frame further has a ducting member at the rear portion of the left and right walls. The ducting member forms an acoustic path that communicates the sound space and the second clearance such that sound pressure behind the loudspeaker mechanism can be radiated through the acoustic port openings via the sound space, the acoustic path, the second clearance and the first clearances.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
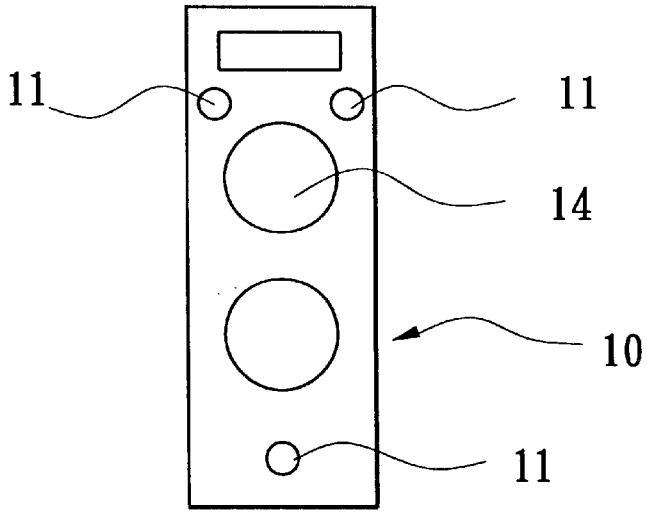
FIG. 1 PRIOR ART
FIG. 1 is a front view of a conventional loudspeaker system.
Figure 2:
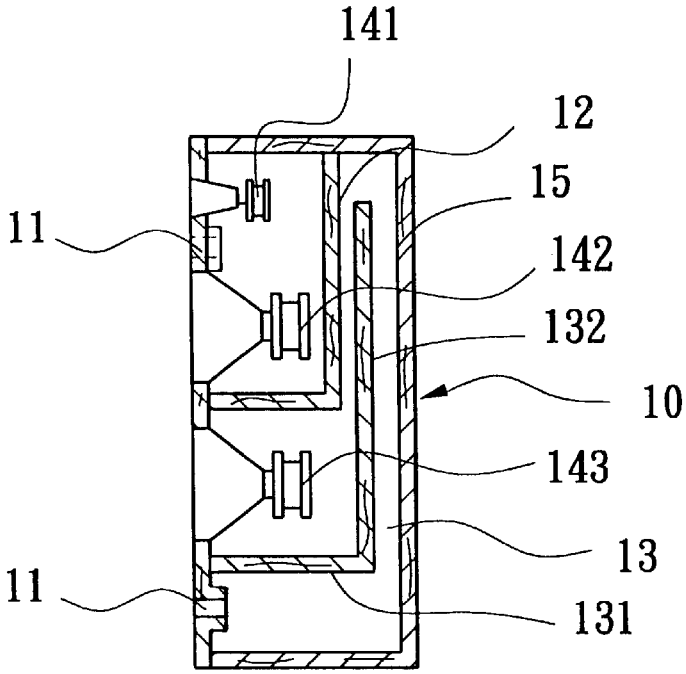
FIG. 2 PRIOR ART
FIG. 2 is a schematic sectional side view of the conventional loudspeaker system of FIG. 1.
Figure 3:
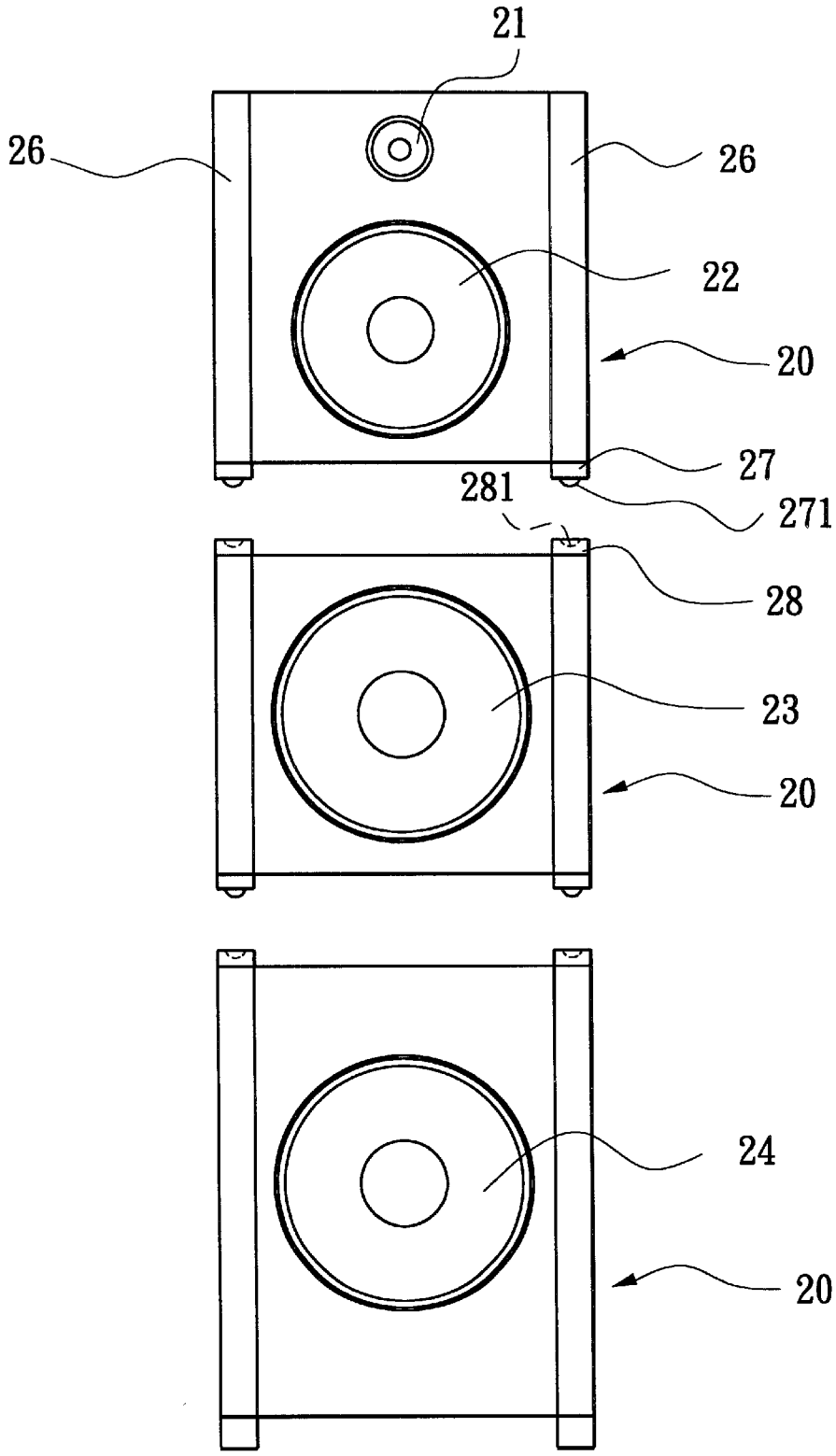
FIG. 3 is a front exploded view showing the preferred embodiment of a loudspeaker system according to this invention.
Figure 4:
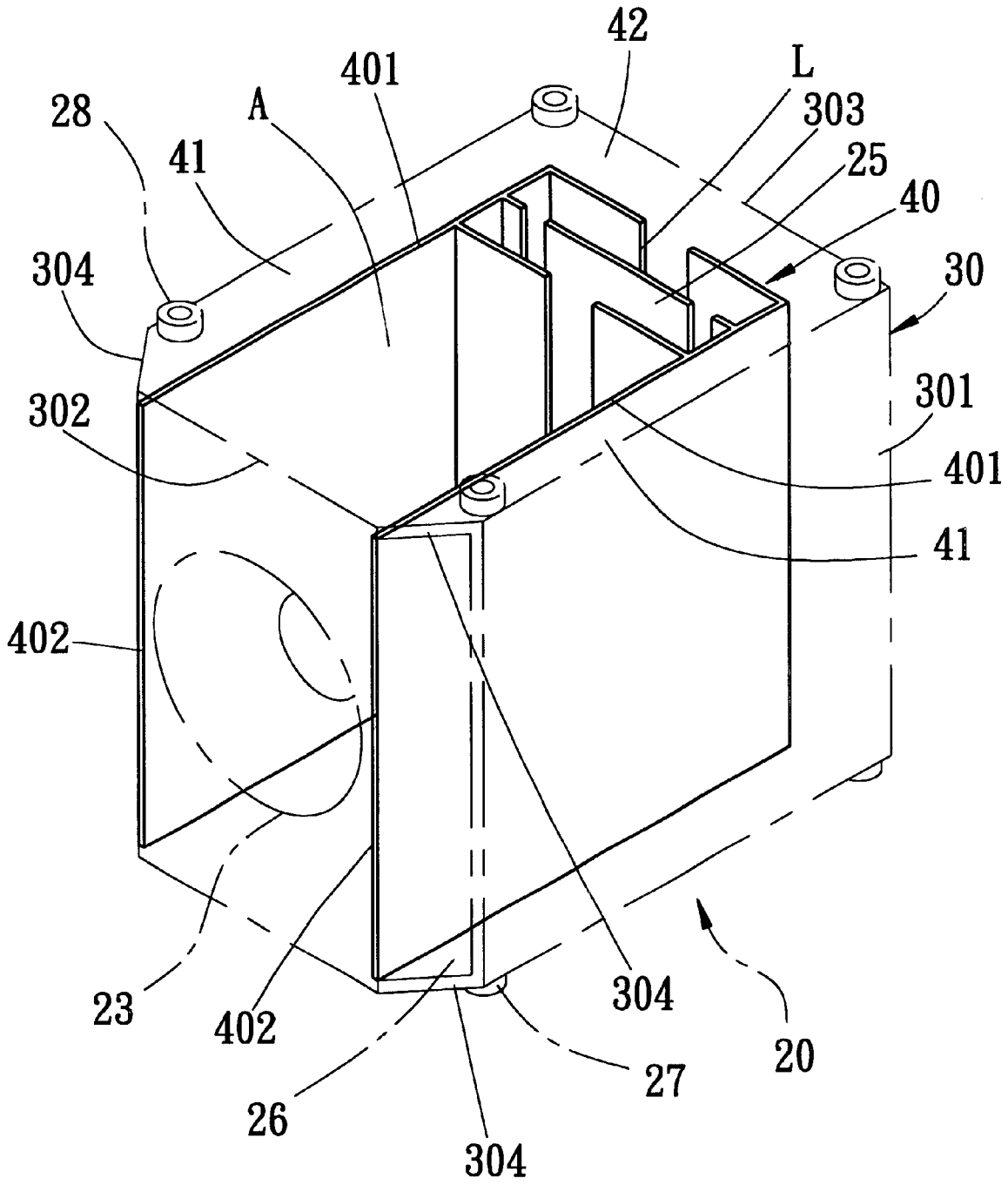
FIG. 4 is a perspective view showing a baffle frame of the preferred embodiment.
Figure 5:
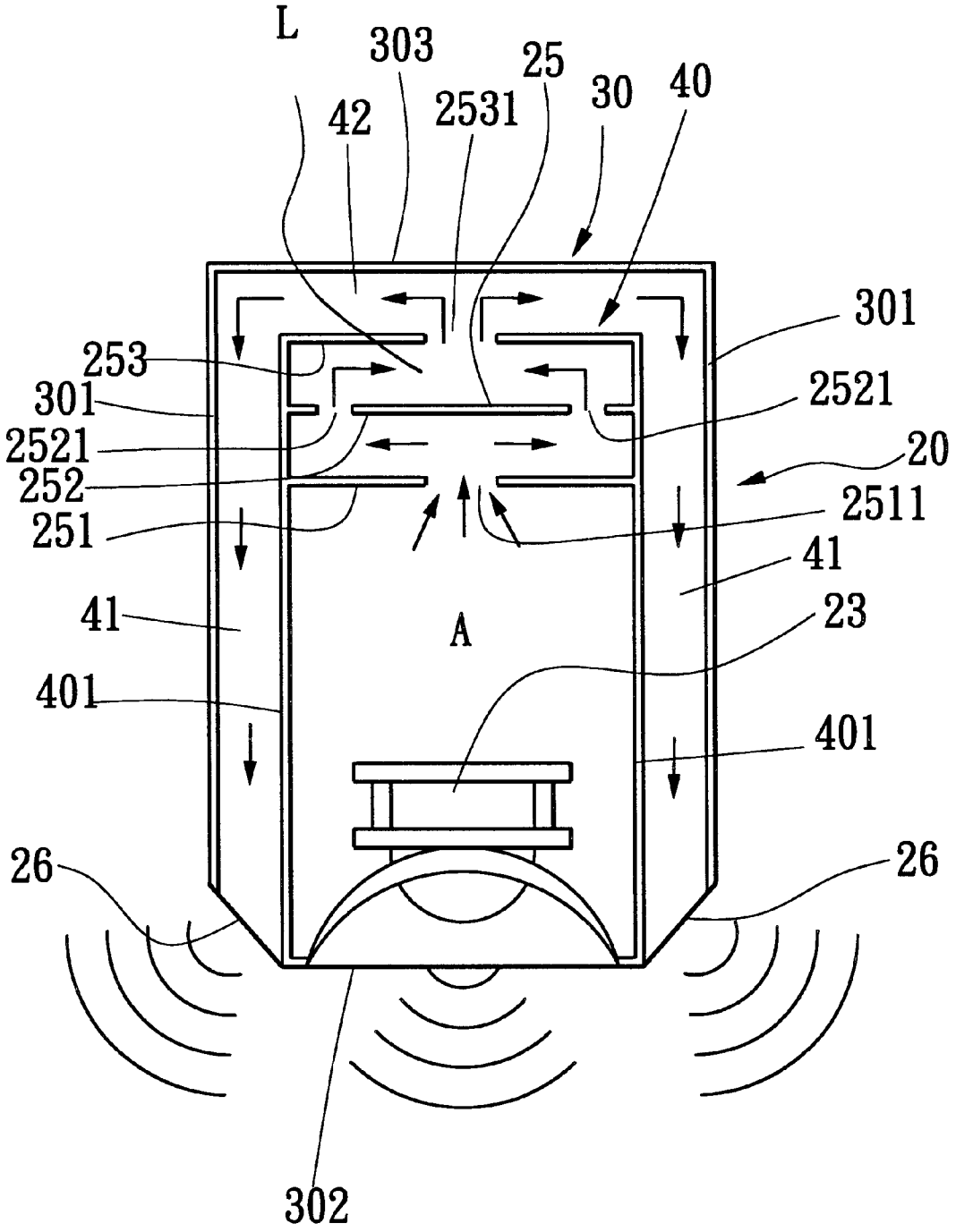
FIG. 5 is a schematic sectional top view showing a loudspeaker enclosure of the preferred embodiment.

Referring to FIGS. 3, 4 and 5, according to the preferred embodiment of this invention, a loudspeaker system includes three loudspeaker units 20. Each of the loudspeaker units 20 has a loudspeaker enclosure and at least one of tweeter, midrange, woofer and subwoofer loudspeaker mechanisms 21, 22, 23, 24. The loudspeaker enclosure includes an outer cabinet body 30 and an inner baffle frame 40.

The cabinet body 30 is rectangular in shape, and has an open front side 302, a closed rear side 303, opposed lateral walls 301 and opposed top and bottom walls that extend in a first horizontal direction between the front and rear sides 302, 303.

As shown in FIG. 4, the baffle frame 40 is disposed in the cabinet body 30, and has parallel left and right walls 401 that extend in a vertical direction between the top and bottom walls and that form a sound space (A) therebetween. The left and right walls 401 further form first clearances 41 with the lateral walls 301 of the cabinet body 30 respectively, and have a front portion 402 that is proximate to the front side 302 of the cabinet body 30 and that has the loudspeaker mechanism 23 mounted thereon. The front portion 402 of the left and right walls 401 cooperates with the lateral walls 301 to form a pair of acoustic port openings 26 at front ends of the first clearances 41. The left and right walls 401 further have a rear portion that forms a second clearance 42 with the rear side 303 of the cabinet body 30. The second clearance 42 is communicated with and extends between rear ends of the first clearances 401 in a second horizontal direction transverse to the first horizontal direction. The top and bottom walls are formed with a pair of beveled edges 304 that extend between the baffle frame 40 and a respective one of the lateral walls 301 at the front side 302 of the cabinet 30 at an angle of about 45° such that the baffle frame 40 projects forwardly relative to the lateral walls 301 to increase the area of the acoustic port openings 26.

As shown in FIG. 5, the baffle frame further has a ducting member 25 at the rear portion of the left and right walls 401. The ducting member 25 forms an acoustic path (L) that communicates the sound space (A) and the second clearance 42 such that sound pressure behind the loudspeaker mechanism 23 can be radiated through the acoustic port openings 26 via the sound space (A), the acoustic path (L), the second clearance 42 and the first clearances 41. In this embodiment, the ducting member 25 includes parallel first, second and third duct plates 251, 252, 253 that extend between the left and right walls 401 in the second horizontal direction. The first duct plate 251 is formed with a first slot 2511 that extends between the top and bottom walls in the vertical direction. The second duct 252 is formed with two second slots 2521 that are parallel to the first slot 2511 and that are staggered relative to the first slot 2511 in the second horizontal direction. The third duct plate 253 is formed with a third slot 2531 that is parallel to the second slot 2521 and that is staggered relative to the second slot 2521 in the second horizontal direction. The second slots 2521 are disposed on left and right sides of the first slot 2511, and the third slot 2531 is aligned with the first slot 2511.

Passage of the sound pressure behind the loudspeaker mechanism 23 through the sound space (A), the acoustic path (L) , the second clearance 42 and the first clearances 41 can minimize echo and resonance and can avoid interference with the sound pressure in front of the loudspeaker mechanism 23.

Figure 6:
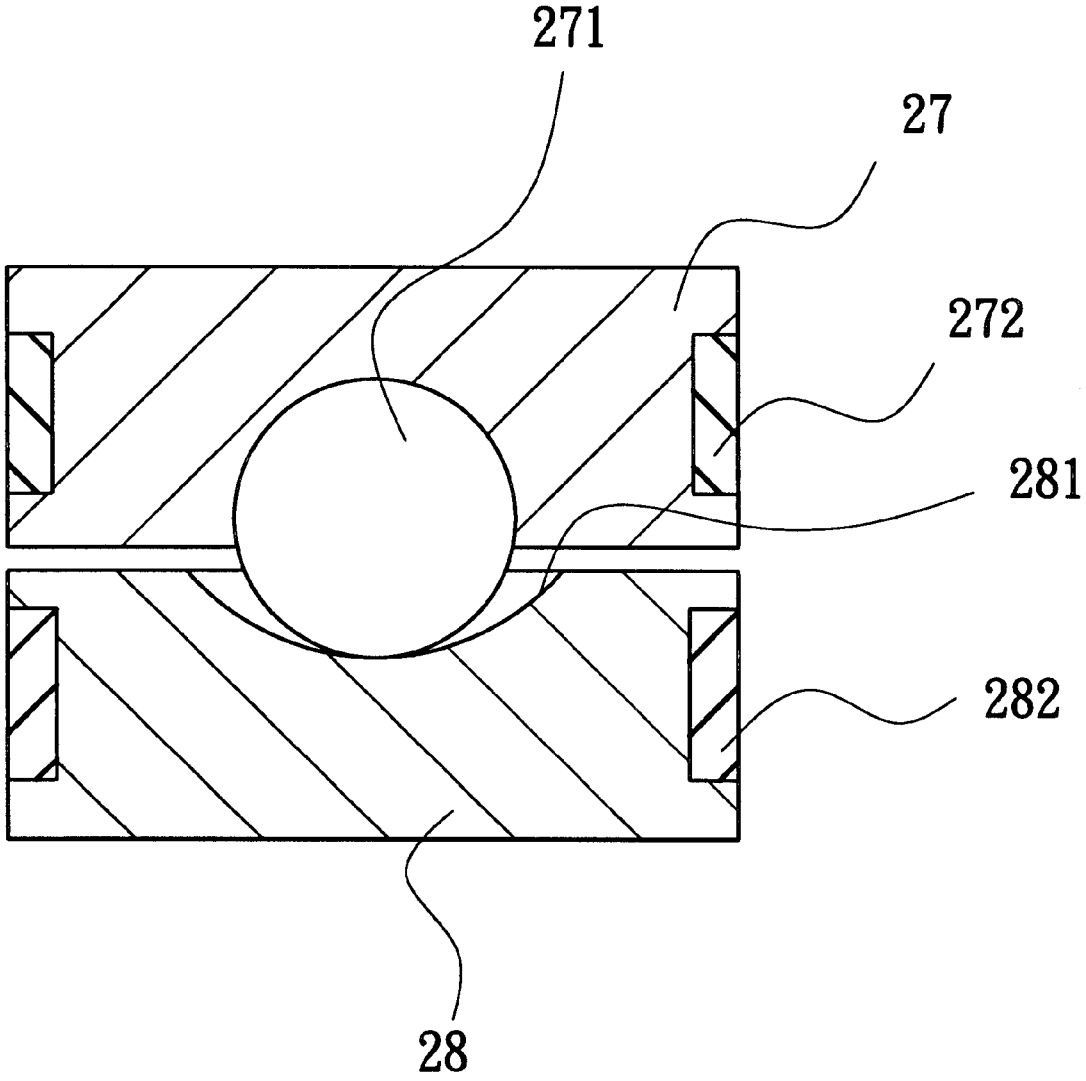
FIG. 6 is a schematic sectional view showing a foot post and a post-receiving recess of the preferred embodiment.

The bottom wall of the cabinet body 30 is formed with a plurality of foot pads 27, while the top wall of the cabinet body 30 is formed with a plurality of receiving seats 28. As shown in FIG. 6, each foot pad 27 has a foot post 271, and each receiving seat 28 has a post-receiving recess 281 for receiving the corresponding foot post 271 of another one of the loudspeaker units 20. The post-receiving recesses 281 are generally concave, whereas the foot posts 271 are generally convex to complement the post-receiving recesses 281. As such, the loudspeaker units 20 can be retained in a stacked position by the foot posts 271 and the post-receiving recesses 281.

Figure 7:
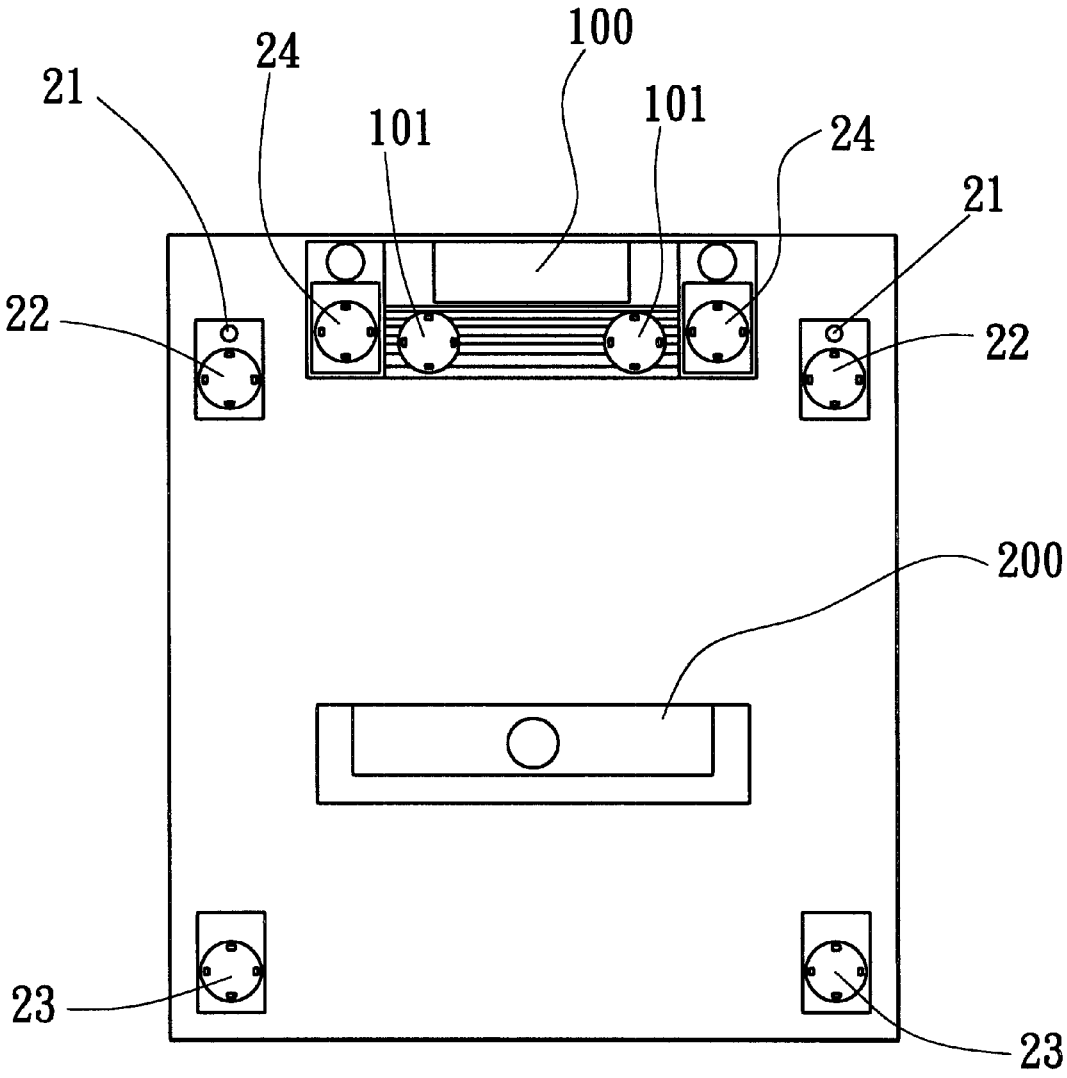
FIG. 7 is a plan view to illustrate how the preferred embodiment can be installed to achieve a surround sound effect.

The loudspeaker system can be installed according to the type of music to be reproduced. For example, when simulating the sound effect at concert halls, the loudspeaker units can be stacked to form a single loudspeaker body. As shown in FIG. 7, when playing a film with Dolby or AC3 surround sound effect at an audiovisual room having a television 100 with two speaker 101 and a user seat 200, in this embodiment, the subwoofer loudspeaker mechanisms 24 are adapted to disposed under the television 100 and in front of the user seat 200. The loudspeaker units having the tweeter and midrange loudspeaker mechanisms 21, 22 are disposed at left and right sides in front of the user seat 200 and can serve as main speakers. The woofer loudspeaker mechanisms 23 are disposed at left and right sides behind the user seat 200 and can serve as rear speakers. Such installation of the loudspeaker system will provide a realistic surround sound effect.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A loudspeaker system comprising at least two loudspeaker units, each including a loudspeaker enclosure and at least one loudspeaker mechanism mounted on said loudspeaker enclosure, wherein said loudspeaker enclosure includes:

an outer cabinet body having an open front side, a closed rear side, opposed lateral walls, and opposed top and bottom walls that extend in a first horizontal direction between said front and rear sides; and an inner baffle frame disposed in said cabinet body and having parallel left and right walls that extend in a vertical direction between said top and bottom walls and that form a sound space therebetween, said left and right walls further forming first clearances with said lateral walls of said cabinet body respectively, and having a front portion that is proximate to said front side of said cabinet body and that has said loudspeaker mechanism mounted thereon, said front portion of said left and right walls cooperating with said lateral walls to form a pair of acoustic port openings at front ends of said first clearances, said left and right walls further having a rear portion that forms a second clearance with said rear side of said cabinet body, said second clearance being communicated with and extending between rear ends of said first clearances in a second horizontal direction transverse to said first horizontal direction, said baffle frame further having a ducting member at said rear portion of said left and right walls, said ducting member forming an acoustic path that communicates said sound space and said second clearance such that sound pressure behind said loudspeaker mechanism can be radiated through said acoustic port openings via said sound space, said acoustic path, said second clearance and said first clearances.

2. The loudspeaker system as claimed in claim 1, wherein said bottom wall of said cabinet body is formed with a plurality of foot posts, said top wall of said cabinet body of each of said loudspeaker units being formed with a plurality of post-receiving recesses for receiving said foot posts of said cabinet body of another one of said loudspeaker units.

3. The loudspeaker system as claimed in claim 2, wherein said post-receiving recesses are generally concave, said foot posts being generally convex to complement said post-receiving recesses.

4. The loudspeaker system as claimed in claim 1, wherein said top and bottom walls are formed with a pair of beveled edges that extend between said baffle frame and a respective one of said lateral walls at said front side of said cabinet body such that said baffle frame projects forwardly relative to said lateral walls to increase area of said acoustic port openings.

5. The loudspeaker system as claimed in claim 1, wherein said ducting member includes:

parallel first, second and third duct plates that extend between said left and right walls in said second horizontal direction;

said first duct plate being formed with a first slot that extends between said top and bottom walls in said vertical direction;

said second duct plate being formed with at least one second slot that is parallel to said first slot and that is staggered relative to said first slot in said second horizontal direction;

said third duct plate being formed with a third slot that is parallel to said second slot and that is staggered relative to said second slot in said second horizontal direction.

6. The loudspeaker system as claimed in claim 5, wherein said second duct plate is formed with two second slots that are disposed on left and right sides of said first slot, and said third slot is aligned with said first slot.

7. A loud speaker enclosure for aloud speaker mechanism, comprising:

an outer cabinet body having an open front side, a closed rear side, and opposed lateral walls and opposed top and bottom walls that extend in a first horizontal direction between said front and rear sides; and an inner baffle frame disposed in said cabinet body and having parallel left and right walls that extend in a vertical direction between said top and bottom walls and that form a sound space therebetween, said left and right walls further forming first clearances with said lateral walls of said cabinet body respectively, and having a front portion that is proximate to said front side of said cabinet body and that is adapted for mounting the loudspeaker mechanism thereon, said front portion of said left and right walls cooperating with said lateral walls to form a pair of acoustic port openings at front ends of said first clearances, said left and right walls further having a rear portion that forms a second clearance with said rear side of said cabinet body, said second clearance being communicated with and extending between rear ends of said first clearances in a second horizontal direction transverse to said first horizontal direction, said baffle frame further having a ducting member at said rear portion of said left and right walls, said ducting member forming an acoustic path that communicates said sound space and said second clearance.

8. The loudspeaker enclosure as claimed in claim 7, wherein said bottom wall of said cabinet body is formed with a plurality of foot posts, said top wall of said cabinet body being formed with a plurality of post-receiving recesses for receiving said foot posts of said cabinet body of another said loudspeaker enclosure.

9. The loudspeaker enclosure as claimed in claim 8, wherein said post-receiving recesses are generally concave, said foot posts being generally convex to complement said post-receiving recesses.

10. The loudspeaker enclosure as claimed in claim 7, wherein said top and bottom walls are formed with a pair of beveled edges that extend between said baffle frame and a respective one of said lateral walls at said front side of said cabinet body such that said baffle frame projects forwardly relative to said lateral walls to increase area of said acoustic port openings.

11. The loudspeaker enclosure as claimed in claim 7, wherein said ducting member includes parallel first, second and third duct plates that extend between said left and right walls in said second horizontal direction, said first duct plate being formed with a first slot that extends between said top and bottom walls in said vertical direction, said second duct plate being formed with at least one second slot that is parallel to said first slot and that is staggered relative to said first slot in said second horizontal direction, said third duct plate being formed with a third slot that is parallel to said second slot and that is staggered relative to said second slot in said second horizontal direction.

12. The loudspeaker enclosure as claimed in claim 11, wherein said second duct plate is formed with two second slots that are disposed on left and right sides of said first slot, and said third slot is aligned with said first slot.

* * * * *